US008220130B2

(12) United States Patent
Robbins et al.

(10) Patent No.: US 8,220,130 B2
(45) Date of Patent: Jul. 17, 2012

(54) METHOD FOR MANUFACTURING AN UNDERGROUND STORAGE TANK FOR FLAMMABLE AND COMBUSTIBLE LIQUIDS

(75) Inventors: Jess A. Robbins, La Jolla, CA (US); Richard J. Sharpe, Del Mar, CA (US)

(73) Assignee: Plasteel International, Inc., Carlsbad, CA (US)

( * ) Notice: Subject to any disclaimer, the term of this patent is extended or adjusted under 35 U.S.C. 154(b) by 425 days.

(21) Appl. No.: 12/567,486

(22) Filed: Sep. 25, 2009

(65) Prior Publication Data

US 2010/0012662 A1 Jan. 21, 2010

Related U.S. Application Data

(63) Continuation-in-part of application No. 11/782,817, filed on Jul. 25, 2007, now abandoned.

(51) Int. Cl.

| | |
|---|---|
| ***B21D 39/00*** | (2006.01) |
| ***B21D 51/18*** | (2006.01) |
| ***F17C 1/04*** | (2006.01) |
| ***F17C 1/10*** | (2006.01) |
| ***F17C 1/14*** | (2006.01) |

(52) U.S. Cl. ..... 29/458; 29/260; 29/525.13; 29/527.1; 29/527.2; 220/560.03; 220/567.1; 220/567.2; 220/588

(58) Field of Classification Search ..... 29/458, 29/460, 527.1, 527.2, 525.13, 407.01, 407.05; 220/560.03, 567.1, 567.2, 588, 592, 650
See application file for complete search history.

(56) References Cited

U.S. PATENT DOCUMENTS

| | | | | |
|---|---|---|---|---|
| 4,927,050 | A * | 5/1990 | Palazzo | 220/560.03 |
| 4,999,900 | A * | 3/1991 | Anderson | 29/407.01 |
| 5,103,996 | A * | 4/1992 | McGarvey | 220/560.01 |
| 5,129,540 | A * | 7/1992 | Palazzo | 220/62.22 |
| 5,168,352 | A * | 12/1992 | Naka et al. | 348/34 |
| 5,809,650 | A * | 9/1998 | Reese et al. | 29/897.3 |
| 6,491,180 | B2 * | 12/2002 | Distelhoff et al. | 220/562 |
| RE38,433 | E * | 2/2004 | Seal et al. | 29/469.5 |

* cited by examiner

*Primary Examiner* — Jermie Cozart
(74) *Attorney, Agent, or Firm* — Nydegger & Associates

(57) ABSTRACT

A method for manufacturing a tank for storing flammable and combustible liquids underground includes fabricating a cylindrical tank core. Structurally, the core encloses a chamber and has an outer surface. Further, the core includes at least one opening for monitoring the integrity of the chamber positioned on the core's bottom centerline. Also, the tank includes a screen attached to the outer surface of the core along the bottom centerline to cover the opening. Moreover, a foil is affixed to the screen and to the outer surface of the tank core. Sprayed or applied on the foil is a seamless jacket formed from polyurea, thermoplastic, polyurethane or polyamine epoxy to encapsulate the tank core.

16 Claims, 2 Drawing Sheets

METHOD FOR MANUFACTURING AN UNDERGROUND STORAGE TANK FOR FLAMMABLE AND COMBUSTIBLE LIQUIDS

This application is a continuation-in-part of application Ser. No. 11/782,817, filed Jul. 25, 2007 now abandoned. The contents of application Ser. No. 11/782,817 are incorporated herein by reference.

FIELD OF THE INVENTION

The present invention pertains generally to underground storage tanks and to methods for manufacturing such tanks. More particularly, the present invention pertains to vessels that include multiple layers for totally containing fluids, providing means for monitoring inner layer breech, and protecting the vessel from external corrosion. The present invention is particularly, but not exclusively, useful as a jacketed secondary containment underground tank for flammable and combustible liquid storage.

BACKGROUND OF THE INVENTION

Many of today's existing gas stations were built prior to the 1980s. While gas station buildings may have been upgraded since then, often the original underground tanks used to store the fuel have not been replaced. These tanks are generally cylindrical and are composed of primarily unprotected steel with approximately 6 mm of steel thickness. Usually, the tanks are located underground and surrounded by backfill materials, or concrete ballast, to provide support for the tank. Typically, the tanks were designed to have a life of about 30 years. Further, it has been found that existing tanks have suffered external corrosive damage, in particular, pitting corrosion. In extreme cases, external corrosion can lead to penetration of the steel tank material that will cause fluid to leak from the tank to the environment. This can be hazardous, especially if the leaking fluid is flammable and combustible or poisonous. It also poses a contamination threat to nearby underground drinking water sources.

External corrosion of steel tanks takes place by localized electrochemical reactions on the surface of the steel which may be caused by soil conductivity, or by chemicals dissolved in water or moisture present in the ground. Particularly problematic is pitting external corrosion, because the corroded site tends to be quite small. As a result, chemical and electrochemical reactions occurring in the "pit" tend to produce high concentrations of corrosive ions and a high current density which accelerate external corrosion processes. Also, steel is susceptible to stress external corrosion cracking where the presence of corrosive agents at a crack can produce rapid propagation of the crack.

In order to avoid the problems associated with older steel tanks, regulations of certain states currently require secondary containment double wall construction for underground flammable and combustible liquid storage tanks. Recently, the Federal government has implemented regulations that require all states to have secondary containment tanks at locations near drinking water sources. Secondary containment construction provides secondary fluid containment to resolve environmental contamination considerations. Such secondary containment tank construction constitutes, in effect, an outer secondary containment structure that is supported about an inner primary steel tank. As a result, the interface between the inner primary tank and outer secondary containment structure defines a secondary contained (double wall) tank which provides for secondary containment of the fluid in the event a leak should develop through the wall of the inner tank.

To detect a leak in a secondary containment tank, liquid-sensing monitors are conventionally located in communication with one or more low zones in the secondary containment space (interstice) between the inner primary steel tank and the outer secondary containment structure. Such liquid-sensing monitors are generally located at the bottom of the interstice. Therefore, any leakage outwardly through a breach in the inner primary tank into the interstice, or inwardly through a breach in the secondary containment structure into the interstice, is directed by gravity toward the monitor sensors which then provide an alarm signal to surface equipment indicating the leakage.

While the design of secondary containment tanks is sound, there have been concerns with the integrity of the secondary containment structure. Specifically, the outer secondary containment structure must exhibit superior strength and durability while protecting the inner steel shells and steel heads against external corrosion. Consequently, the importance of providing a durable and reliable outer secondary containment cannot be understated.

In light of the above, it is an object of the present invention to provide a storage tank for containing flammable and combustible liquids in which a polymer (e.g. polyurea, thermoplastic, polyurethane or polyamine epoxy) jacket acting as the outer secondary containment structure encapsulates the inner primary steel tank. Another object of the present invention is to provide a tank in which the secondary containment jacket is formed from a spray-applied polymer (e.g. polyurea, thermoplastic, polyurethane or polyamine epoxy). Still another object of the present invention is to provide a method of manufacturing an underground storage tank in which a polymer (e.g. polyurea, thermoplastic, polyurethane or polyamine epoxy) is sprayed onto a foil or formable sheeting material that encapsulates the inner primary steel tank and cures to form a secondary containment jacket encapsulating the inner primary steel tank. It is another object of the present invention to provide a secondary containment (double wall) tank and method of manufacturing a tank for storing flammable and combustible liquids that is easy to implement, cost effective, simple to install, and that provides a long service life.

SUMMARY OF THE INVENTION

In accordance with the present invention, a tank is provided for storing flammable and combustible liquids underground. Structurally, the tank includes a primary steel or metal alloy tank core that encloses a chamber (primary tank) and has an outer surface. Further, the core includes a substantially cylindrical body that defines both an axis and a bottom centerline, with the bottom centerline parallel to the axis. Also, the core includes two heads that seal the open ends of the cylindrical body. For purposes of the present invention, the cylindrical body is provided with an interstice opening positioned along the bottom centerline for monitoring the integrity of the primary tank.

In addition to the core, the tank includes a conduit member such as an aluminum screen. Specifically, the screen is attached to the outer surface of the core along its bottom centerline to cover the monitoring opening. For the present invention, the screen provides a communication channel to expedite fluid travel to the monitoring opening. Further, the tank includes an aluminum foil sheeting that is affixed to the screen and to the outer surface of the tank core. The foil defines the area of the core for secondary containment, and thus serves as a barrier to prevent the polymer (e.g. polyurea, thermoplastic, polyurethane or polyamine epoxy) from bonding to the core in this area. Accordingly, the foil covers the monitoring opening in the tank core. In order to encapsulate the tank core, the tank is provided with a seamless jacket that is sprayed onto, or otherwise applied to the foil.

With this construction, the screen prevents pinching of the jacket to the tank core at the bottom centerline where the system's compression forces are greatest. Also, the screen expedites the flow of any liquid at the bottom centerline to the monitor opening. Importantly, the screen provides these features while adding very little additional volume to the interstice between the tank core and the secondary containment jacket.

Functionally, the foil serves as a barrier to define the secondary containment space. Further, the foil provides additional containment to the primary tank and secondary containment jacket material, a vapor barrier around the primary tank that is impervious to hydrocarbon vapors, and electrochemical protection against external corrosion for the primary steel tank in the event of a secondary containment jacket breech. Also, the foil's ability to be formed and remain molded around the primary tank's irregular shape minimizes the volume of the interstitial space. Thus, less of a leakage from a primary tank or outer secondary breech will happen before gravity diverts the fluid to the monitor opening. With the foil's ability to conform tightly to the primary tank's structure, the foil allows the secondary containment jacket to structurally act as a composite material on a steel surface. With the lack of space between the secondary containment jacket's inner surface and the secondary containment jacket's outer surface (0 to 0.002 inches for the majority of the interstice), the steel greatly increases the physical properties of the polyurea, thermoplastic, polyurethane or polyamine epoxy (i.e., bending, impact resistance).

In manufacturing the primary tank, the primary tank core is first fabricated by constructing the steel cylindrical body, and sealing the open ends of the cylindrical body with two heads. Then, the monitoring opening is formed into the cylindrical body of the tank core. Thereafter, the area around openings on the top centerline of the tank core is sandblasted to near white metal. After the core is prepared in this manner, the screen is attached to the outer surface of the tank core along the bottom centerline. Next, the foil is affixed tightly to the screen and to the outer surface of the tank core, except for the areas sandblasted around top centerline openings. Finally, the polyurea, thermoplastic, polyurethane or polyamine epoxy is sprayed onto the foil and over the entire steel primary tank, with the polyurea, thermoplastic, polyurethane or polyamine epoxy curing quickly to form the seamless secondary containment jacket that encapsulates the tank core. The polyurea, thermoplastic, polyurethane or polyamine epoxy is bonded directly to the core's steel surface around openings thus forming a closed space with the monitor opening as the only entrance.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
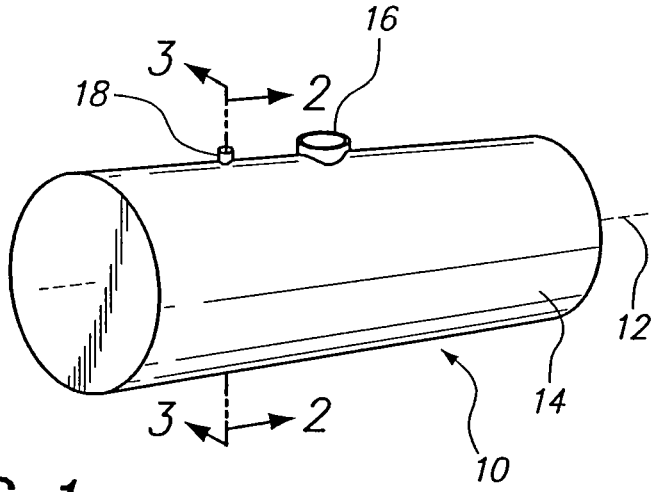
FIG. 1 is a not-to-scale perspective view of an underground storage tank in accordance with the present invention.

Referring initially to FIG. 1, a tank for storing flammable and combustible liquids underground is shown, and is generally designated 10. As shown, the tank 10 has a substantially right circular cylindrical configuration as is typical for underground storage tanks, such as those normally employed for the storage of hydrocarbon fuels such as gasoline and diesel fuel. In FIG. 1, the tank 10 is illustrated in the position in which such a tank is typically located underground, i.e., on its side with the cylindrical axis 12 disposed generally horizontally. It is to be understood, however, that the present invention is equally applicable for use with tanks of other overall configurations, orientations, and locations. As shown, the tank 10 includes a polymer (e.g. polyurea, thermoplastic, polyurethane or polyamine epoxy) jacket 14 that encapsulates the other components of the tank 10. Also, the tank 10 includes a pipe fitting 16 that provides for fluid communication between the tank 10 and other devices. Further, another opening 18 in the pipe provides for monitoring of the tank's integrity.

Figure 2:
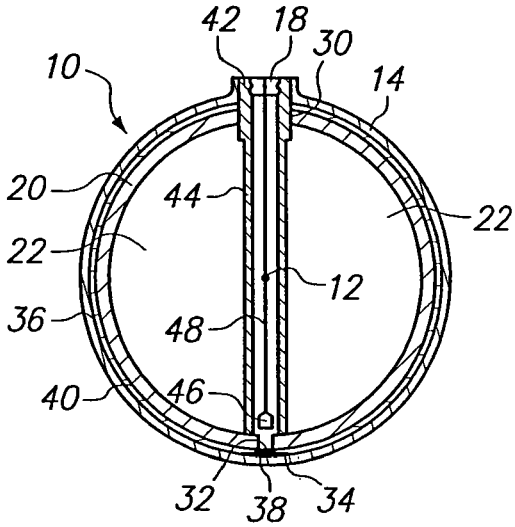
FIG. 2 is a not-to-scale cross sectional view of the underground storage tank taken along line 2-2 in FIG. 1.

Referring now to FIG. 2, the internal components of the tank 10 are illustrated. As shown, the tank 10 includes a core 20 that defines the chamber 22 within the tank 10. For purposes of the present invention, the core 20 is rigid, fluid-tight, and is typically fabricated of steel, or other metal alloy. As a result, the core 20 serves as the primary fluid containment for the tank 10. As shown, the core 20 includes a cylindrical body portion 24 that has two open ends 26 (shown in FIG. 3) that are sealed by a pair of end heads 28 (shown in FIG. 3). Also, the core 20 includes an opening 30 and an opening 32 to provide for leak detection. As shown in FIG. 2, the opening 32 is positioned along the bottom centerline 34 of the core 20. Also, the core 20 includes an outer surface 36.

As shown in FIG. 2, the tank 10 is provided with a conduit member (i.e. screen) 38 that is attached to the outer surface 36 of the core 20 along the bottom centerline 34. While the conduit member 38 may be composed of a variety of material such as mesh-type materials, fiberglass mats, nonmetallic fibers, strands of fiberglass roving, or coated materials, preferably, the conduit member 38 is an aluminum screen. It is noted that, during the curing process of polyurea, thermoplastic, polyurethane or polyamine epoxy, a large amount of heat is given off which can melt or consume the conduit member 38 if not made from the proper material. In certain embodiment, the conduit member 38 is standard technical grade aluminum screening with a 14×14 to 20×20 mesh, and with a wire diameter of about 0.008 to 0.020 inches. Further, it is preferred that the screen 38 have a minimum width of about 6 inches and a maximum width that covers no more than the bottom half of the core 20, i.e., a maximum width of $R(\pi)$, wherein R is the radius of the outer surface 36 of the core 20. In certain embodiments, the preferred maximum width of the screen 38 is $R(\pi/n)$, where n is 2, 3, 4 or 6.

Figure 3:
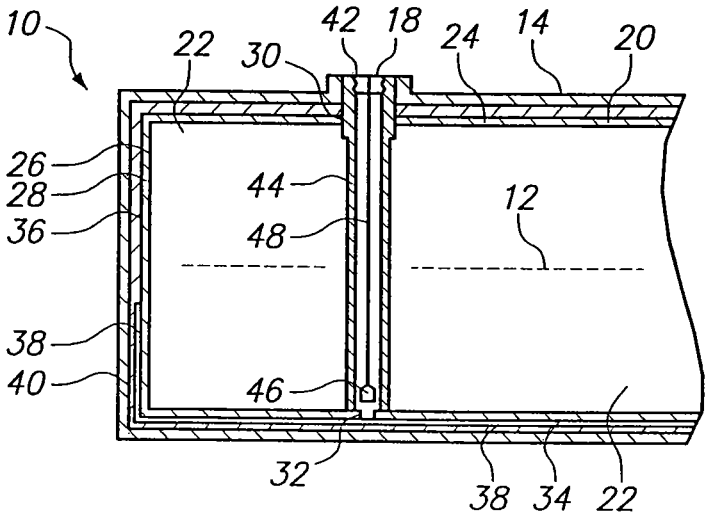
FIG. 3 is a not-to-scale cross sectional view of the underground storage tank taken along line 3-3 in FIG. 1.

As shown, the screen 38 is centered about the bottom centerline 34. As shown in FIG. 3, the screen 38 extends from the cylindrical body portion 24 over the end head 28. Further, the screen 38 extends radially inward along the end head 28 from the bottom centerline 34 for a minimum of 12 inches. Importantly, the screen 38 is centered on the monitoring opening 32.

As shown in FIGS. 2 and 3, the tank 10 further includes an intermediate barrier layer 40, such as foil sheeting. As shown, the foil sheeting 40 is affixed to the outer surface 36 of the core 20 and to the screen 38. As a result, the screen 38 is encapsulated between the sheeting 40 and the core 20. With this structure, the sheeting 40 provides a secondary containment space for capturing any fluid that leaks from the core 20. Preferably, the sheeting 40 is aluminum foil, which has a higher electrode potential than iron so as to provide cathodic protection for the steel core 20. While aluminum foil is preferred due to cost considerations, other foils such as metallic coated materials or other metallic foils may form the sheeting 40. Also, the sheeting 40 preferably has a radially-extending thickness of about 1.5 mils. Due to the thinness and formability of the sheeting 40, the secondary containment space is minimized and monitoring sensitivity is increased.

Still referring to FIGS. 2 and 3, it can be seen that the jacket 14 encapsulates the tank core 20 to form a substantially rigid secondary fluid containment. For purposes of the present invention, the jacket 14 is formed from a cured polymer spray of polyurea, thermoplastic, polyurethane or polyamine epoxy, and is presented as a seamless, unitary, one-piece member. Polyurea, thermoplastic, polyurethane or polyamine epoxy are non-flammable and have zero hazardous air pollutants. Preferably, the jacket 14 exhibits the following specifications:

Elongation (ASTM D 412): 25%
Tensile Strength (ASTM D 412): 3800 psi
Hardness (ASTM D 2240): 70 Shore "D"
Modulus (ASTM D 790): 65,000 psi+/−5000
Shrinkage (ASTM D 955): 0.007 in./in.
Impact (ASTM D 256): 14.5 ft/lb
Tear Resistance (ASTM D 1938): 600 psi
Low Temperature Flexibility (ASTM D 1737): Passes ½" mandrel at −20° F.
Dry Temperature Resistance (continuous): 200° F.
Dry Temperature Resistance (intermittent): 250° F.
Underwriters Laboratories Inc. Standard 1746, 3rd Edition.

As shown in FIGS. 2 and 3, a monitoring fitting 42 extends through, and is sealed against, the opening 18 and opening 30. As further shown, an interstitial monitor access fitting 42 extends through, and is sealed against, the opening 18 and opening 30. Further, the tank 10 is provided with a pipe 44 that is bonded to the fitting 42 and passes through the chamber 22. As shown, the pipe 44 is bonded to the core 20 enclosing the opening 32 at the bottom centerline 34. Also, the tank 10 is typically equipped with a monitor sensor 46 which is lowered through the pipe 44 to near the bottom centerline 34 via a cable 48. For leak monitoring, the cable 48 connects to surface electronic alarm and readout equipment (not shown).

Figure 4:
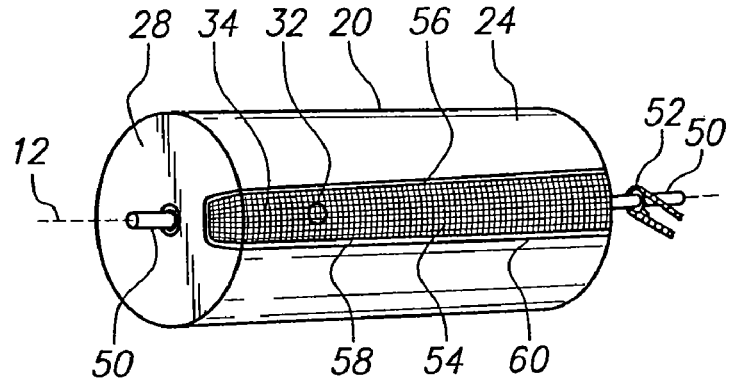
FIG. 4 is a not-to-scale perspective view of the tank core shown with the screen attached along the bottom centerline.

FIG. 4 illustrates further characteristics of the core 20. As shown in FIG. 4, the core 20 is fabricated with a cylindrical body portion 24 and end heads 28. Further, an opening 32 has been formed in the cylindrical body portion 24 along the bottom centerline 34 (In FIG. 4, the core 20 has been rotated about the axis 12 to allow a view of the bottom centerline 34). As shown in FIG. 4, during manufacture of the tank 10, the core 20 is mounted to two stub axles 50. Also, the axles 50 are connected to a drive assembly 52 for rotating the core 20 about the axis 12. In FIG. 4, it can be seen that a strip of aluminum screen 54 has been attached to the core 20. As shown, the screen 54 is centered on the bottom centerline 34 and extends azimuthally between two opposite edges 56 and 58 for a width of about six inches. In this manner, the opening 32 is completely covered by the screen 54. Also, the screen 54 extends along the heads 28 from the bottom centerline 34 toward the axis 12 for at least twelve inches. In FIG. 4, it is further seen that the edges 56 and 58 of the screen 54 are attached to the core 20 with aluminum adhesive tape 60. Importantly, the screen 54 must be centered over any monitoring openings in the core 20, and no tape 60 should lie over any openings.

Figure 5:
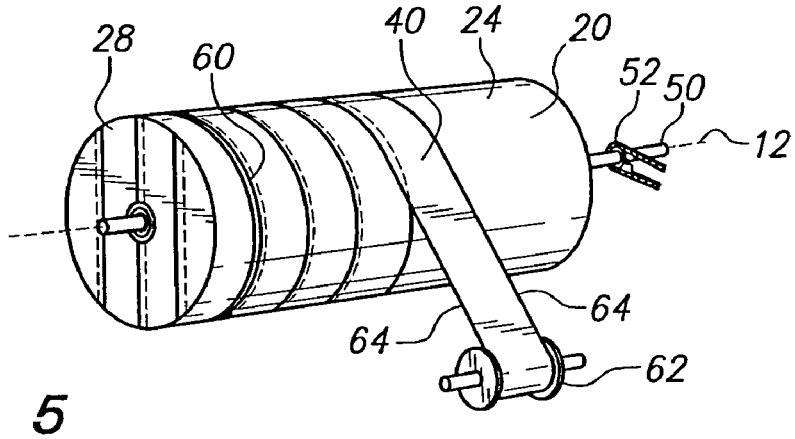
FIG. 5 is a not-to-scale perspective view of the tank core of FIG. 4 during application of the foil sheeting.
Figure 6:
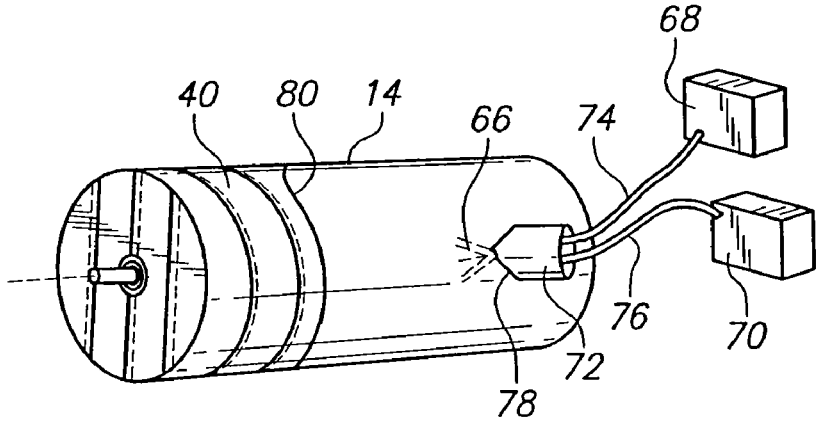
FIG. 6 is a not-to-scale perspective view of the tank core and sheeting of FIG. 5 during application of the polyurea, thermoplastic, polyurethane or polyamine epoxy jacket.

Cross-referencing FIG. 4 with FIGS. 5-6, provides an understanding of the method of manufacturing the tank 10. It is noted that, before the screen 54 is attached to the core 20, all visible oil, grease, mill scale, and weld splatter is removed from the core 20 and all fittings in accordance with SSPC-SP1. Further, the areas of the core 20 around fittings are blasted with abrasive to Near White Blast in accordance with SSPC-SP10.

After the screen 54 is attached to the core 20, the aluminum foil sheeting 40 is attached. As shown in FIG. 5, the sheeting 40 covers both the end heads 28 and the cylindrical body portion 24 of the core 20. In order to wrap the sheeting 40 around the cylindrical body portion 24 of the core 20, the drive assembly 52 rotates the core 20 about the axis 12. As a result, the sheeting 40, which is initially mounted on a spool 62, is wound onto the core 20. In FIG. 5, the sheeting 40 is shown to include edges 64. Importantly, when applied to the core 20, the edges 64 overlap to allow the sheeting 40 to provide containment. Also, an aluminum adhesive tape 60 is used to affix the edges 64 of the sheeting 40 to the core 20 or to an underlying layer of sheeting 40. The sheeting 40 is held back from top centerline openings on the sandblasted areas to provide an adequate polyurea sealing perimeter around the openings.

As shown in FIG. 6, the jacket 14 is formed over the sheeting 40 on the core 20. For purposes of the present invention, the jacket 14 is formed from spray polymer 66 (polyurea, thermoplastic, polyurethane or polyamine epoxy). As is typical, the polymer 66 is formed from two types of components "A" and "B". For the present invention, the A component, which is a prepolymer, is a low to medium viscosity, solventless, resin. Further, the A component may be an aromatic or aliphatic isocyanate prepolymer. In FIG. 6, the A component is stored in source 68.

In an embodiment of the present invention, the B component of the polymer 66 is a polyether-amine or an amine terminated polyol. It is very reactive and is auto-catalytic (i.e., it does not require a catalyst). The reactivity is typically in the 3-15 second range. Due to the speed of the reactivity, the polymer 66 is not affected by humidity or moist surfaces (the A and B components react so quickly, that the A component does not have the opportunity to react with water). In FIG. 6, the B component is stored in source 70.

As shown in FIG. 6, the sources 68 and 70 are connected to a pump 72 via tubes 74 and 76. Further, the pump 72 is connected to a spray nozzle 78. Due to the reactivity of the components A and B, they are not mixed until spraying. As shown in FIG. 6, approximately two-thirds of the tank 10 has been sprayed with polymer 66 with the interface being at 80. After the sheeting 40 is covered in the polymer 66, the polymer 66 is allowed to cure (the polymer 66 can gel in approximately three to fifteen seconds). After the jacket 14 is completely formed to encapsulate the sheeting 40 and core 20, the tank 10 is as shown in FIG. 1.

For the present invention, it is noted that the polymer 66 can be applied at 20-30° F., ambient temperature, which is lower than typical polyurethanes. Also, the polymer 66 is solventless, stiff and exhibits excellent impact resistance over a wide range of temperatures as noted above. Importantly, the polymer 66 has good acid resistance and low water absorption. Further, the polymer 66 is resistant to creepage and penetration, resistant to heat warpage and cracking. Some properties of the polymer 66 include: solids by volume: 99% +/−1; zero volatile organic compounds; theoretical coverage of 1604 sq.ft./gal. at 1 mil (3.8 sq. m./gal. at 1 mm); a recommend DFT (applied in multiple passes) of 50-250 mils (1.3-6.4 mm); a mix ratio (by volume): 1"A":1"B"; and a flash point (PMCC) of 275° F. (135° C. ).

While the particular Improved Underground Storage Tank for Flammable and Combustible Liquids as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. A method for manufacturing a tank for storing flammable and combustible liquids underground which comprises the steps of:

fabricating a tank core defining a chamber and having an outer surface;

forming at least one opening in the tank core;

attaching a conduit member along the bottom centerline of the core;

affixing a foil to the conduit member and to the outer surface of the tank core; and applying a polymer to the foil, with the polymer forming a seamless, corrosion resistant, jacket secondary containment structure encapsulating the tank core.

2. A method as recited in claim 1 wherein the applying step includes spraying the polymer onto the foil, and wherein the polymer cures onto the jacket secondary containment structure as a unitary one-piece member.

3. A method as recited in claim 1 wherein the tank core defines a bottom centerline, wherein the bottom centerline passes through the opening in the tank core, and wherein, during the attaching step, the conduit member is affixed to the outer surface of the tank core along the bottom centerline, with the conduit member covering the opening thereon.

4. A method as recited in claim 3 wherein the conduit member is bounded by edges and wherein the attaching step includes taping the edges to the outer surface of the tank core with adhesive tape.

5. A method as recited in claim 4 wherein the conduit member is an aluminum screen and wherein the adhesive tape is aluminum.

6. A method as recited in claim 3 further comprising the step of sandblasting selected areas of the tank core to near white metal before the attaching and affixing steps.

7. A method as recited in claim 1 wherein the core is substantially cylindrical and defines an axis, and wherein the fabricating step comprises:

constructing a cylindrical body having two open ends; and sealing the two open ends with heads.

8. A method as recited in claim 1 wherein the core is substantially cylindrical and defines an axis, and wherein the polymer jacket has a radially-extending thickness of about 100 mils.

9. A method as recited in claim 8 wherein the foil has a radially-extending thickness of about 1.5 mils.

10. A method as recited in claim 1 wherein the tank core is a metal alloy and wherein the foil is aluminum.

11. A method as recited in claim 1 wherein the polymer is selected from a group consisting of polyurea, thermoplastic, polyurethane and polyamine epoxy.

12. A method for manufacturing a tank for storing flammable and combustible liquids underground which comprises the steps of:

fabricating a generally rigid primary fluid containment tank core defining a chamber and having an outer surface;

forming an opening in the tank core for monitoring the integrity of the chamber;

attaching a conduit member along the bottom centerline of the core to cover the opening;

affixing an intermediate barrier layer to the outer surface of the core and to the conduit member, with said barrier layer covering the opening; and applying a polymer to the barrier layer, with the polymer forming a seamless generally rigid secondary fluid containment jacket encapsulating the tank core.

13. A method as recited in claim 12 wherein the tank core defines a bottom centerline, wherein the bottom centerline passes through the opening in the tank core, and wherein, during the attaching step, the conduit member is attached to the outer surface of the tank core along the bottom centerline.

14. A method as recited in claim 12 wherein the applying step includes spraying the polymer onto the barrier layer, and wherein the polymer cures into the jacket as a unitary one-piece member.

15. .A method as recited in claim 14 wherein the polymer is selected from a group consisting of polyurea, thermoplastic, polyurethane and polyamine epoxy.

16. A method as recited in claim 15 wherein the conduit member is bounded by edges and wherein the attaching step includes taping the edges to the outer surface of the tank core with adhesive tape.

* * * * *